US007791443B1

(12) United States Patent
Ju

(10) Patent No.: US 7,791,443 B1
(45) Date of Patent: Sep. 7, 2010

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/708,409

(22) Filed: Feb. 18, 2010

(51) Int. Cl.
*H01F 27/04* (2006.01)

(52) U.S. Cl. ..... 336/107; 439/66

(58) Field of Classification Search ..... 336/107, 336/192, 200; 439/55, 65–73, 91, 591
See application file for complete search history.

(56) References Cited

U.S. PATENT DOCUMENTS 4,130,327 A * 12/1978 Spaulding ..... 439/71
6,488,513 B1 * 12/2002 Neidich et al. ..... 439/66
6,872,082 B2 * 3/2005 Hsu et al. ..... 439/66
7,275,936 B1 * 10/2007 Ju ..... 439/66

* cited by examiner

*Primary Examiner*—Tuyen Nguyen
(74) *Attorney, Agent, or Firm*—Muncy, Geissler, Olds & Lowe, PLLC

(57) ABSTRACT

An electrical connector includes an insulating body, which has plural front and rear rows of accommodating troughs for receiving electrical conductive terminals, and two protective blocks protruded upwardly. The accommodating portion has a first accommodating portion, a second accommodating portion extending laterally from the first accommodating portion, and a third accommodating portion extending rearwards from the first accommodating portion. A rear row of the second accommodating portions are located behind the adjacent front row of third accommodating portions. The electrical conductive terminal has a base, a material-belt connecting portion extending from one side of the base, an elastic arm extending from the elastic arm. The elastic arm is adjacent to and exceeds the material-belt connecting portion. The elastic arms of the rear row of the electrical conductive terminals are located between the two adjacent elastic arms of the front row of the electrical conductive terminals.

10 Claims, 4 Drawing Sheets

ELECTRICAL CONNECTOR

BACKGROUND OF THE INVENTION

1. Field of the Invention

The present invention relates to an electrical connector and in particular to an electrical connector capable of preventing from generating a short circuit.

2. Description of Prior Art

With the advancement of the electronic industry, electrical connectors have become more and more important. Thus, it is an increasing need to improve the performance of electrical connectors. Under the same condition, in order to increase the transmission efficiency of the electrical connector, a common solution in this art is to increase the number of terminals. However, since the mainboard becomes smaller and smaller, the available space for the electrical connector on the mainboard is decreased accordingly. Thus, it is necessary for the terminals to be arranged more densely, so that various designs of the electrical connectors are developed.

A conventional electrical connector at an earlier stage includes an insulating body provided with plural transverse and longitudinal rows of accommodating holes, and a plurality of terminals received in the accommodating holes respectively. Each of the terminals has a base received in the accommodating hole, an elastic arm extending upwards from the base with a portion thereof protruding from the accommodating hole, a contact portion provided at a distal end of the elastic arm, and a soldering portion extending downwards from the base. The front row of longitudinal accommodating holes is located in the same longitudinal direction as the adjacent rear row of accommodating holes.

The electrical connector allows a chip to be mounted therein. When the chip is mounted on the insulating body, the chip is pressed to contact the contacting portions of the terminals. Here, with regard to two adjacent terminals of the same longitudinal row, the elastic arms of the rear row of terminals are located above the elastic arms of the front row of terminals while the chip is conductively connected to the contact portions. However, such an electrical conductor has problems as follows. Since the terminals are arranged more densely in the electrical connector, the elastic arms of the front row of terminals will be brought into contact with the elastic arms of the rear row of terminals easily when the chip is pressed excessively with an improper operation. As a result, short circuit or interference of signals will be generated.

In view of the above problems, another kind of electrical connector is developed. The electrical connector includes an insulating body having plural rows of longitudinal and transverse accommodating holes. A plurality of terminals is received in the accommodating holes respectively. Each of the terminals has a base received in the accommodating hole, an elastic arm extending upwards and obliquely from the base to protrude partially outside of the accommodating hole, a contacting portion provided at a distal end of the elastic arm, and a soldering portion extending downwards from the base. The front row of the accommodating holes and the rear row of the accommodating holes are positioned in the same longitudinal direction.

The electrical connector allows a chip to be mounted thereon. When the chip is mounted on the insulating body, the chip is pressed to contact the contacting portions of the terminals. Here, with regard to the two adjacent terminals of the same longitudinal row, the elastic arms of the rear row of terminals are located between the elastic arms of the two adjacent terminals in the front row while the chip is conductively connected to the contact portions respectively.

Although this kind of electrical connector avoids the problem of short circuit in the previous electrical connector, it still brings about some problems as follows.

(I) The elastic arm of the terminal extends obliquely from the base. Since the elastic arm has a larger elasticity, it may elastically swing. Further, the contact portion is located at the distal end of the elastic arm, so that the contact between the chip and the contacting portions may become poor when the chip is pressed to abut the contacting portions.

(II) Since the elastic arm of the terminal extends upwards and obliquely from the base, the adjacent terminals may still generate a short circuit due to an improper operation.

(III) If the volume of the terminal is maintained constant, the size of the accommodating hole cannot be reduced, thus, the terminals and the accommodating holes are still arranged in an array with longitudinal and transverse rows. In order to increase the transmission efficiency of the electrical connector, it is necessary to increase the number of the terminals and in turn the volume of the insulating body, thus, the space occupied by the electrical connector on the mainboard is inevitably increased.

(IV) When the chip is mounted on the insulating body, fasteners and heat sinks provided on the chip will totally exert a large force to the chip. Since the chip directly abuts the contacting portions of the terminals, the terminals may suffer damage or get fatigue more easily because there is no supporting means for the terminals. As a result, the electrical conductivity of the electrical connector is deteriorated greatly.

Thus, there is a need to develop a novel electrical connector in order to overcome the above problems.

SUMMARY OF THE INVENTION

An objective of the present invention is to provide an electrical connector capable of preventing from generating a short circuit by means of an alternative arrangement. Further, the electrical connector occupies less space.

In order to achieve the above objective, the present invention is to provide an electrical connector, which includes an insulating body having plural front and rear rows of accommodating troughs and a plurality of electrical conductive terminals are received in the accommodating troughs respectively. Each of the accommodating troughs has a first accommodating portion penetrating the insulating body, a second accommodating portion extending laterally from the first accommodating portion in the same level, a third accommodating portion extending rearwards from the first accommodating portion. The second accommodating portions of the rear row of the accommodating troughs are located behind the third accommodating portions of the adjacent front row of the accommodating troughs. The insulating body is protruded upwardly with at least two protective blocks, and a plurality of electrical conductive terminals are received in the accommodating troughs respectively. Each of the electrical conductive terminals has a base, a material-belt connecting portion, and an elastic arm. The base is crossed the first accommodating portion and the second accommodating portion. The material-belt connecting portion is extending upwards from one side of the base into the second accommodating portion. The protective block is located higher than the material-belt connecting portion. The elastic arm is extending rearwards from one side of the base and then extending forwards and upwards. The elastic arm is adjacent to the material-belt connecting portion and exceeding the material-belt connecting portion. The elastic arm enters the third accommodating portion from the first accommodating portion and protrudes upwards outside of the accommodating trough. The elastic arms of the rear row of the electrical conductive terminals are located between two adjacent elastic arms of the front row of the electrical conductive terminals.

In comparison with prior art, according to the electrical connector of the present invention, since the elastic arms of the rear row of the electrical conductive terminals are located between the two adjacent elastic arms of the front row of the electrical conductive terminals. Thus, the adjacent front and rear rows of the electrical conductive terminals can be avoided from generating a short circuit or colliding with each other.

Further, the insulating body protrudes upwards to form at least two protective blocks that are located higher than the material-belt connecting portion. The electrical connector allows a chip to be mounted thereon. Therefore, when the chip is mounted on the electrical connector, the contacting portions of the electrical conductive terminals can be electrically connected to the chip. When the chip is pressed to a certain position at which the protective chips abut the chip, the chip can be supported partially by the protective blocks, so that the weight of the chip does not completely exert a force on the electrical conductive terminals. With this arrangement, the electrical conductive terminals can be protected from suffering damage, thereby maintaining the normal operation of the electrical connector.

Further, since the second accommodating portions of the rear row of the accommodating troughs are located behind the third accommodating portions of the adjacent front row of the accommodating troughs. Such an alternative arrangement allows more accommodating troughs to be provided in the same space of the insulating body and makes the electrical conductive terminals to be arranged more densely, thereby increasing the transmission efficiency of the electrical conductor.

DETAILED DESCRIPTION OF THE INVENTION

In order to understand the objective, structure, characteristics, and effects of the present invention better, a description relating thereto will be made with reference to preferred embodiments thereof and the accompanying drawings. However, the drawings are illustrative only but not used to limit the present invention.

Figure 1:
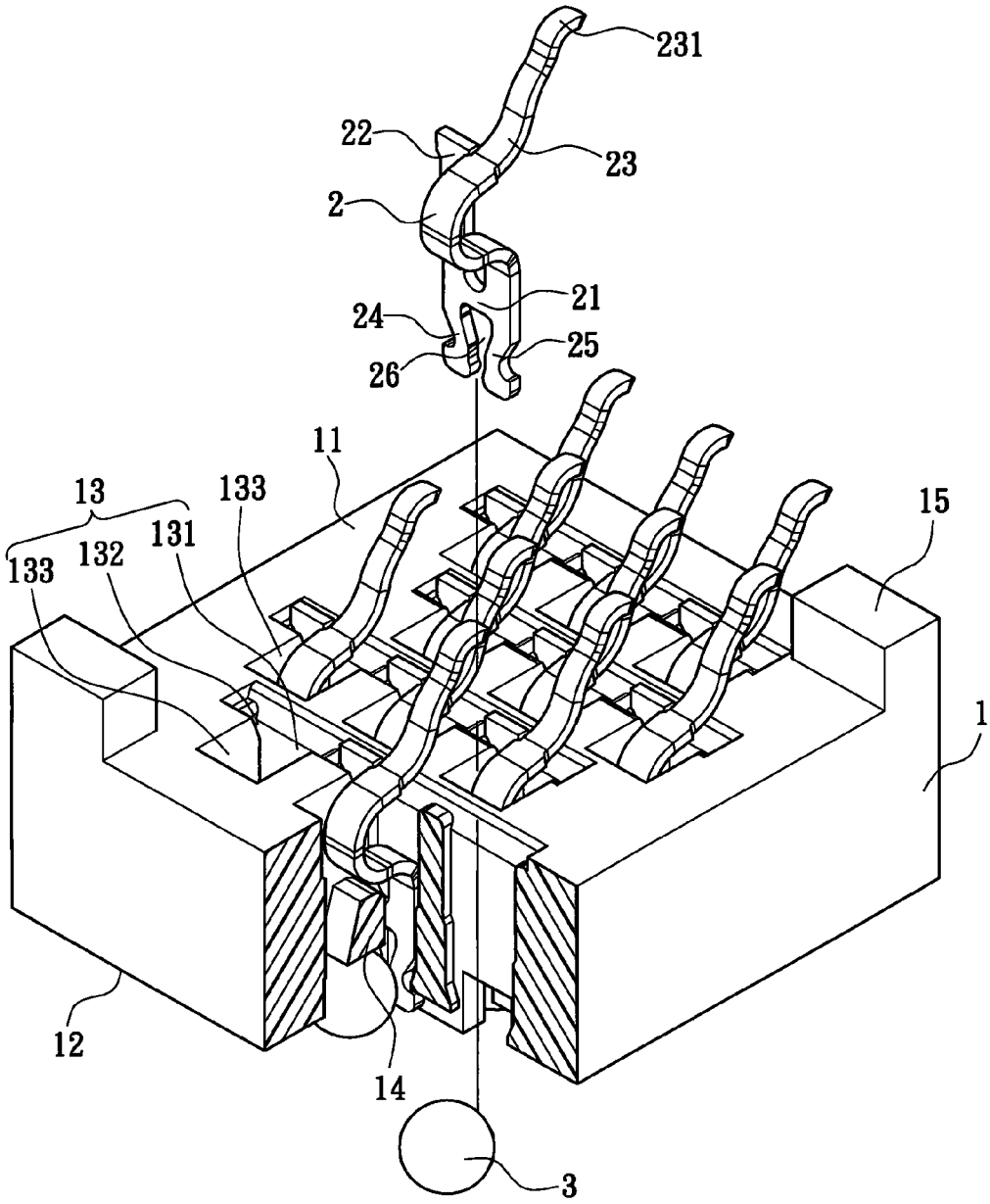
FIG. 1 is a partially exploded cross-sectional view showing the electrical connector of the present invention.

Please refer to FIG. 1. The electrical connector of the present invention includes an insulating body 1, a plurality of electrical conductive terminals 2 fixed in the insulating body 1, and a plurality of solder balls 3 received in the insulating body 1 to correspond to the electrical conductive terminals 2 respectively.

Figure 2:
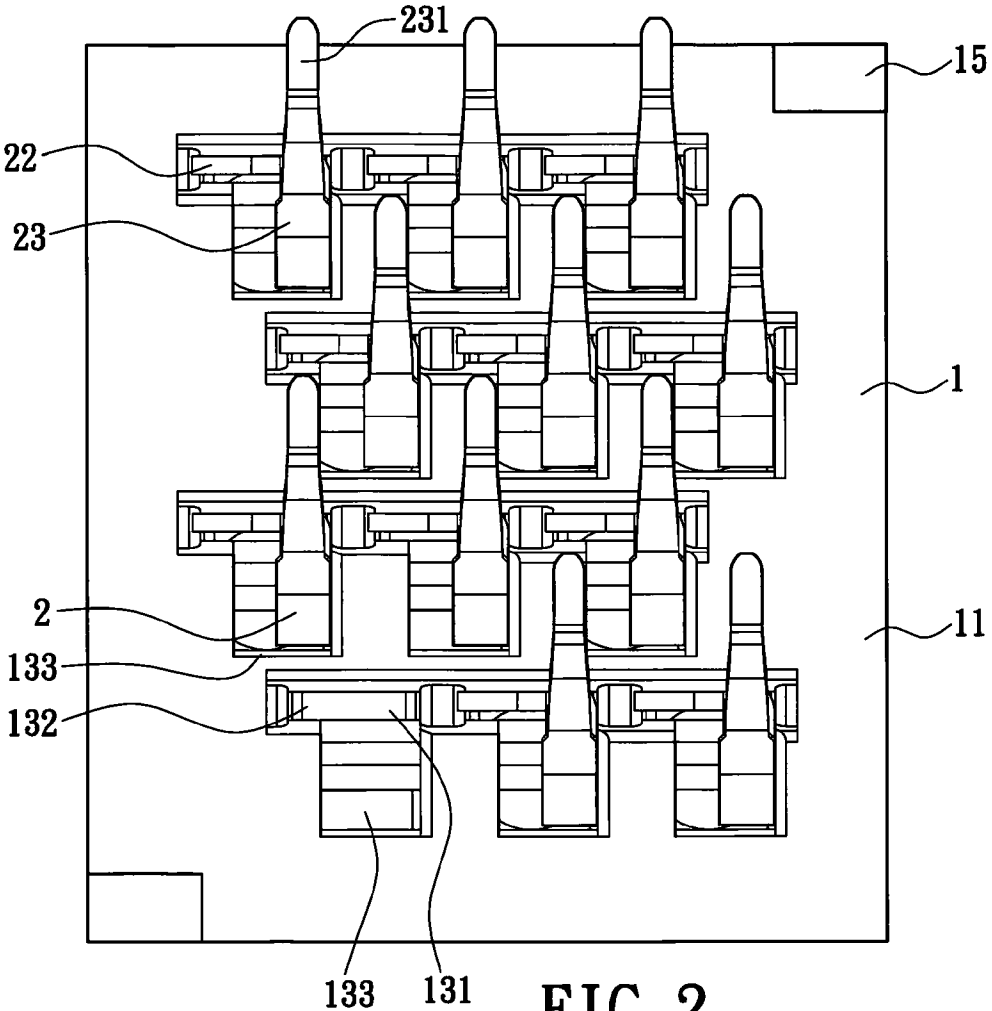
FIG. 2 is a partially assembled view showing the electrical connector of the present invention.
Figure 3:
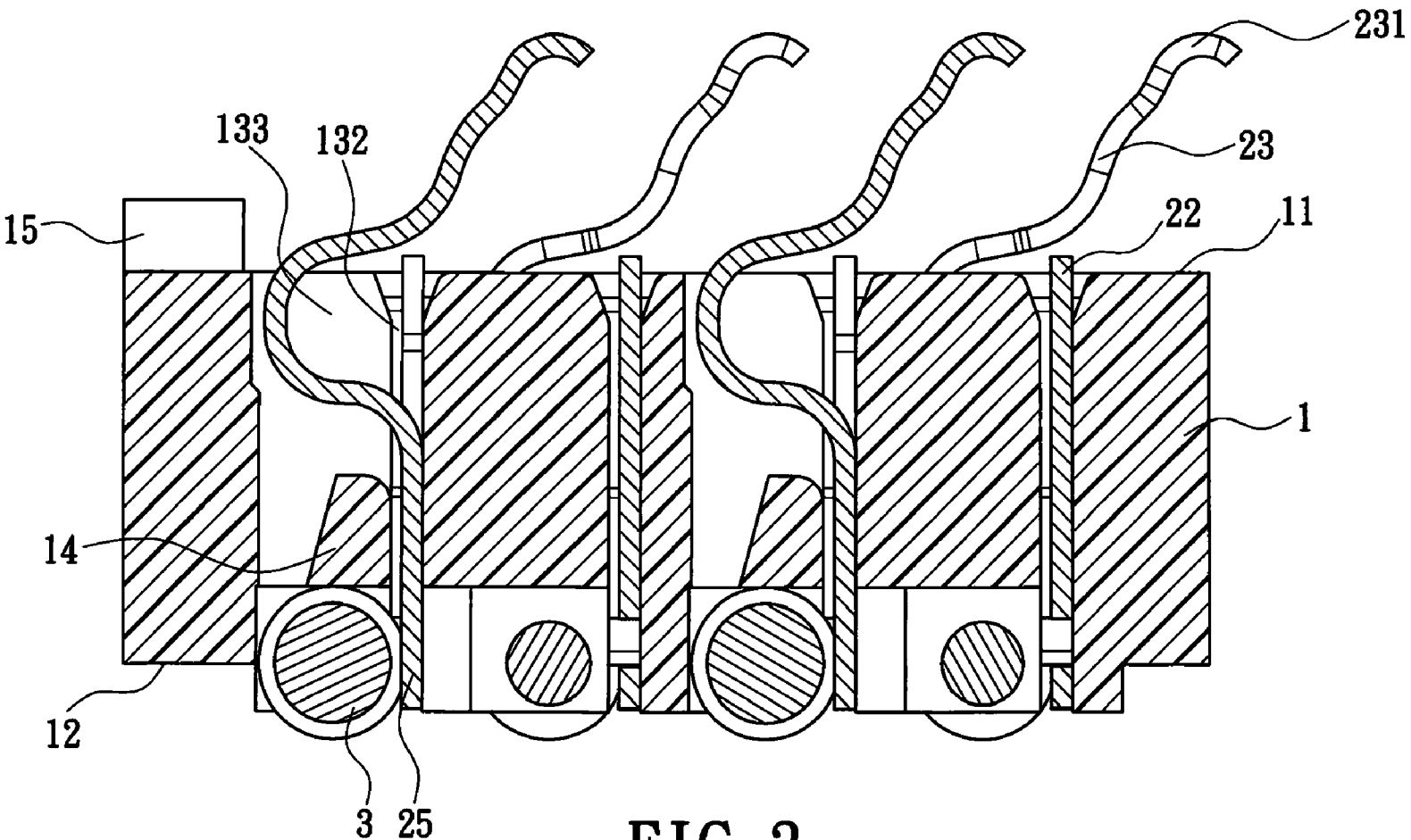
FIG. 3 is an assembled cross-sectional view showing the electrical connector of the present invention.

Please refer to FIGS. 1 to 3. The insulating body 1 includes an upper surface 11 and a lower surface 12 opposite to the upper surface 11. A plurality of accommodating troughs 13 is formed to penetrate the upper surface 11 and the lower surface 12. The accommodating troughs 13 are arranged in longitudinal and transverse rows on the insulating body 1. Each of the accommodating troughs 13 is formed into an inverted L shape with a first accommodating portion 131. The left side of the first accommodating portion 131 extends to form a second accommodating portion 132 in the same level as that of the first accommodating portion 131. There is connectivity between the first accommodating portion 131 and the second accommodating portion 132. The rear side of the first accommodating portion 131 extends vertically to form a third accommodating portion 133, and there is partial connectivity between the third accommodating portion 133 and the first accommodating portion 131 and the second accommodating portion 132 partially. The second accommodating portions 132 of the rear row of the accommodating troughs 13 are located behind the third accommodating portions 133 of the adjacent front row of the accommodating troughs 13 respectively. The first accommodating portions 131 of the rear row of the accommodating troughs 13 are located behind a region between the two adjacent accommodating troughs 13 in the front row. The total width of the first accommodating portion 131 and the second accommodating portion 132 is larger than that of the third accommodating portion 133. A stopper 14 is provided between the first accommodating portion 131 and the third accommodating portion 133.

Further, two corners of the insulating body 1 protrude upwards to form two protective blocks 15 respectively.

Please refer to FIGS. 1 and 3. Each of the electrical conductive terminals 2 includes a base 21, a material-belt connecting portion 22 extending upwards from one side of the base 21, and an elastic arm 23 extending rearwards from one side of the base 21 and then extending forwards and upwards. The elastic arm 23 is adjacent to the material-belt connecting portion 22 and exceeds the material-belt connecting portion 22. A contacting portion 231 is formed at a distal end of the elastic arm 23.

Further, the base 21 extends downwards to form a first soldering portion 24 and a second soldering portion 25 symmetrical with each other. The first soldering portion 24 and the second soldering portion 25 enclose to form an open trough 26.

Figure 4:
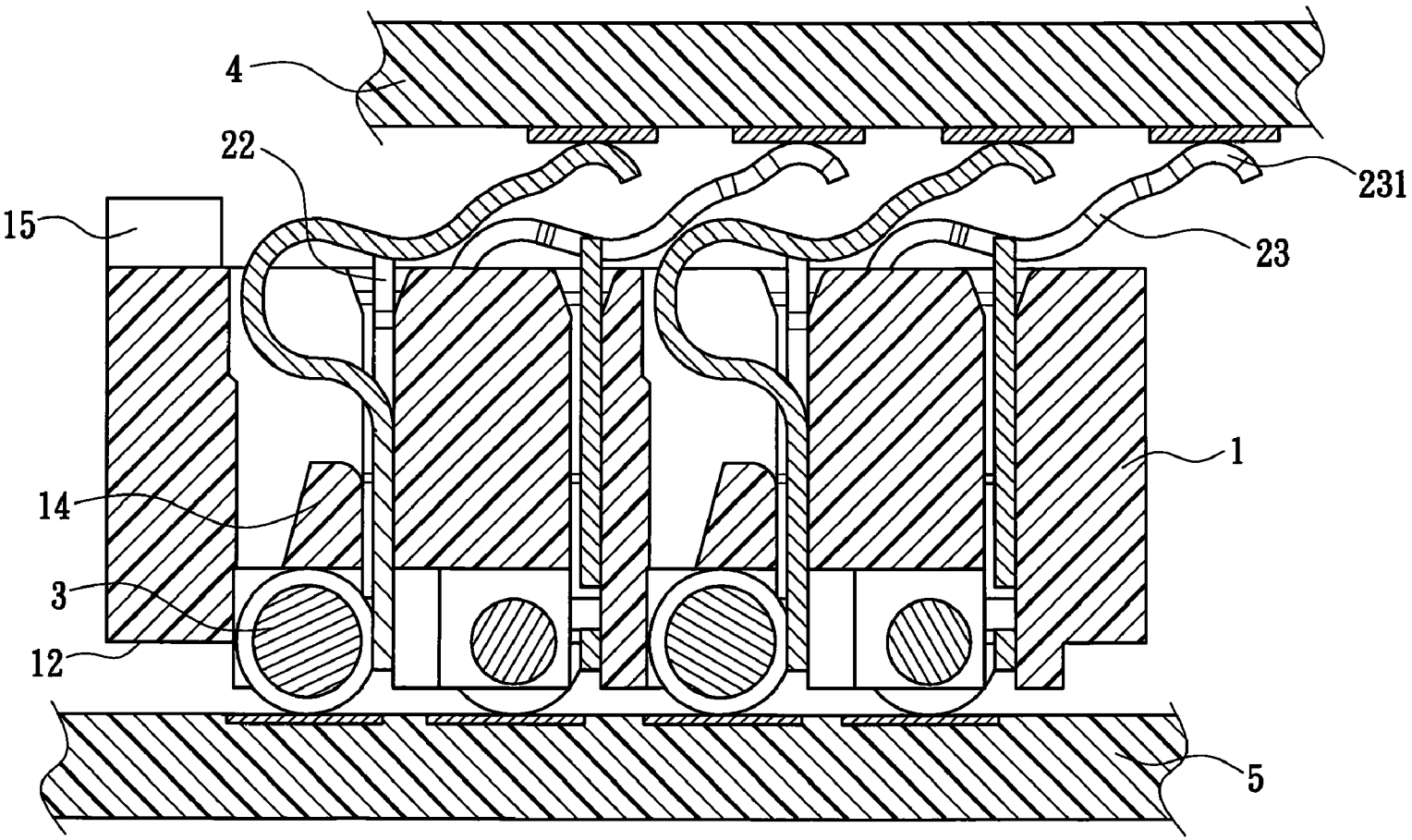
FIG. 4 is a cross-sectional view showing that the electrical conductor of the present invention is soldered on a circuit board and connected to a chip.

Please refer to FIGS. 2 to 4. In assembly, the electrical connector is electrically connected to a chip 4 and a circuit board 5, whereby the chip 4 and the circuit board 5 can be electrically connected with each other.

First, the plurality of electrical conductive terminals 2 is mounted in the insulating body 1. More specifically, the plurality of electrical conductive terminals 2 are mounted from the top into the accommodating troughs 13 correspondingly. The base 21 is located in the first accommodating portion 131 and the second accommodating portion 132 to abut one side of the stopper 14. The material-belt connecting portion 22 is located in the second accommodating portion 132 and partially protrudes from the upper surface 11 of the insulating body 1. The protective block 15 is located higher than the material-belt connecting portion 22. The elastic arm 23 enters the third accommodating portion 133 from the first accommodating portion 131 and then extends upwards to exit the accommodating troughs 13. The first soldering portion 24 is located in the second accommodating portion 132, and the second soldering portion 25 is located in the first accommodating portion 131. Here, the elastic arms 23 of the rear row of the electrical conductive terminals 2 are located between the two adjacent elastic arms 23 of the front row of the electrical conductive terminals 2. The contacting portions 231 of the rear row of the electrical conductive terminals 2 are located behind and above the material-belt connecting portion 22 of the adjacent front row of the electrical conductive terminals 2.

Next, the plural solder balls 3 are disposed in the insulating body 1. The solder balls 3 are disposed from the top into the first accommodating portions 131 and the second accommodating portions 132 of the accommodating troughs 13 respectively and are fixed in the open trough 26. The stopper 14 is configured to prevent the solder ball 3 from moving upwards.

Then, the electrical connector after assembly is soldered onto the circuit board 5. The soldering portions 24 and 25 are soldered onto the circuit board 5 by means of the solder balls 3.

Finally, the chip 4 is mounted on the insulating body 1 of the electrical connector. When the chip 4 is pressed to contact the contacting portions 231 of the electrical conductive terminals 2, the elastic arms 23 of the rear row of the electrical conductive terminals 2 partially exceed the material-belt connecting portions 22 of the adjacent front row of the electrical conductive terminals 2. The chip 4 is pressed on the protective blocks 15. That is to say, the protective blocks 15 provide a supporting force for the chip 4. Thus, the electrical conductive terminals 2 can properly transmit signals from the chip 4 to the circuit board 5 and vice versa.

According to the above, the electrical connector of the present invention has advantageous features as follows.

(I) Since the elastic arms of the rear row of the electrical conductive terminals are located between the two adjacent elastic arms of the front row of the electrical conductive terminals respectively, the adjacent electrical conductive terminals between the front row and the rear row can be prevented from generating a short circuit or colliding with each other.

(II) Since the second accommodating portions of the rear row of the accommodating troughs are located behind the third accommodating portions of the adjacent front row of the accommodating troughs, such an alternative arrangement allows more accommodating troughs to be provided in the insulating body and makes the electrical conductive terminals to be arranged more densely. Thus, the transmission efficiency of the electrical connector can be increased.

(III) Since the insulating body protrudes upwards to form two protective blocks located higher than the material-belt connecting portion, and the chip is pressed on the electrical connector, the contacting portions of the electrical conductive terminals are electrically connected to the chip when the chip is mounted on the electrical connector. When the chip is pressed to a certain position at which the protective blocks abut the chip, the chip are partially supported by the protective blocks, so that the weight of the chip may not completely exert a force on the electrical conductive terminals, thereby preventing the electrical conductive terminals from suffering damage and maintaining the normal operation of the electrical connector.

(IV) When the chip is pressed to contact the contacting portions of the electrical conductive terminals, the elastic arms will move forwards a small distance. Since the elastic arms of the electrical conductive terminals extend rearwards from the base and then extend forwards and upwards, with such a design, the distance which the elastic arms move is shorter than that made by the elastic arms extending directly forwards and upwards. Thus, the electrical conductive terminals can be prevented from generating a short circuit, so that the electrical connection of the electrical conductive terminals can be guaranteed.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An electrical connector, comprising:

an insulating body having a plurality of accommodating troughs in front and rear rows, and at least two protective blocks protruded upwardly from a top surface thereof, wherein each of the accommodating troughs has a first accommodating portion penetrating the insulating body, a second accommodating portion extending laterally in the same level as that of the first accommodating portion, and a third accommodating portion extending rearwards from the first accommodating portion, the second accommodating portions of the rear row of the accommodating troughs being located behind the third accommodating portions of the adjacent front row of the accommodating troughs; and a plurality of electrical conductive terminals received in the accommodating troughs respectively, each of the electrical conductive terminals having:

a base crossing the first accommodating portion and the second accommodating portion;

a material-belt connecting portion extending upwards from one side of the base into the second accommodating portion, the protective block being located higher than the material-belt connecting portion;

an elastic arm extending rearwards from one side of the base and then extending forwards and upwards, the elastic arm being adjacent to the material-belt connecting portion and exceeding the material-belt connecting portion, the elastic arm entering the third accommodating portion from the first accommodating portion and extending upwards to exit the accommodating trough, the elastic arms of the rear row of the electrical conductive terminals being located between two adjacent elastic arms of the front row of the electrical conductive terminals.

2. The electrical connector according to claim 1, wherein the first accommodating portion of the rear row of the accommodating trough is located behind a region between two adjacent accommodating troughs in the front row.

3. The electrical connector according to claim 1, wherein the third accommodating portion is located exactly behind the first accommodating portion.

4. The electrical connector according to claim 1, wherein the material-belt connecting portion extends upwardly to form the second accommodating portion.

5. The electrical connector according to claim 1, wherein the total width of the first accommodating portion plus the second accommodating portion is larger than the width of the third accommodating portion.

6. The electrical connector according to claim 1, wherein each row of the accommodating troughs is in parallel to one side of the insulating body.

7. The electrical connector according to claim 1, wherein a distal end of the elastic arm is formed with a contacting portion, the contacting portions of the rear row of the electrical conductive terminals are located behind and above the material-belt connecting portions of the adjacent front row of the electrical conductive terminals respectively.

8. The electrical connector according to claim 1, wherein the base extends downwards to form a first soldering portion and a second soldering portion, the first soldering portion and the second soldering portion enclose to form an open trough.

9. The electrical connector according to claim 8, wherein the first soldering portion and the second soldering portion are symmetrical with each other.

10. The electrical connector according to claim 8, further comprising a solder ball fixed in the open trough.

* * * * *